US010975865B2

(12) United States Patent
Crum et al.

(10) Patent No.: US 10,975,865 B2
(45) Date of Patent: Apr. 13, 2021

(54) BOLTLESS FIXED SCROLL-TO-FRAME JOINT

(71) Applicant: TRANE INTERNATIONAL INC., Davidson, NC (US)

(72) Inventors: Daniel R. Crum, Huntersville, NC (US); Joseph E. Ziolkowski, Jr., Onalaska, WI (US); Eric S. Mlsna, Cashton, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 305 days.

(21) Appl. No.: 16/071,783

(22) PCT Filed: Jan. 27, 2017

(86) PCT No.: PCT/US2017/015386
§ 371 (c)(1),
(2) Date: Jul. 20, 2018

(87) PCT Pub. No.: WO2017/132533
PCT Pub. Date: Aug. 3, 2017

(65) Prior Publication Data

US 2019/0032658 A1 Jan. 31, 2019

Related U.S. Application Data

(60) Provisional application No. 62/288,250, filed on Jan. 28, 2016.

(51) Int. Cl.
*F04C 18/02* (2006.01)
*F04C 23/00* (2006.01)
*F01C 1/02* (2006.01)

(52) U.S. Cl.
CPC ..... *F04C 18/0215* (2013.01); *F04C 23/008* (2013.01); *F04C 2230/60* (2013.01); *F04C 2240/30* (2013.01)

(58) Field of Classification Search
CPC ..... F04C 18/0215; F04C 23/008; F04C 18/0246; F01C 1/0215
See application file for complete search history.

(56) References Cited

U.S. PATENT DOCUMENTS 4,065,279 A 12/1977 McCullough
5,474,433 A * 12/1995 Chang ..... F04C 18/0215 418/55.4

(Continued)

FOREIGN PATENT DOCUMENTS

CN 1419633 A 5/2003
CN 101294563 A 10/2008

(Continued)

OTHER PUBLICATIONS

Extended European Search Report; European Patent Application No. 17744989.9; dated May 31, 2019 (4 pages).

(Continued)

*Primary Examiner* — Deming Wan
(74) *Attorney, Agent, or Firm* — Hamre Schumann, Mueller & Larson, P.C.

(57) ABSTRACT

A scroll compressor and methods of assembling the scroll compressor are disclosed. The scroll compressor includes a frame aligned about a longitudinal axis of the scroll compressor, the frame including a plurality of extensions extending radially from the longitudinal axis, the plurality of extensions including axially extending frame interlock mechanisms. A fixed scroll support is aligned about the longitudinal axis, the fixed scroll support including a plurality of extensions extending radially from the longitudinal axis, the plurality of extensions including axially extending fixed scroll support interlock mechanisms configured to (Continued)

engage the frame interlock mechanisms upon radial rotation. A fixed scroll wrap is integral with or attached to the fixed scroll support.

18 Claims, 8 Drawing Sheets

(56) References Cited

U.S. PATENT DOCUMENTS

| | | | |
|---|---|---|---|
| 6,027,321 | A | 2/2000 | Shim et al. |
| 6,113,371 | A | 9/2000 | Williams et al. |
| 2003/0095884 | A1 | 5/2003 | Chang |
| 2009/0185932 | A1 | 7/2009 | Beagle et al. |

FOREIGN PATENT DOCUMENTS

| | | | |
|---|---|---|---|
| CN | 101802407 | A | 8/2010 |
| KR | 0173581 | B1 | 3/1999 |
| WO | 01-73296 | | 10/2001 |

OTHER PUBLICATIONS

International Search Report and Written Opinion, International patent Application No. PCT/US2017/015386, dated May 2, 2017 (13 pages).
Office Action, Chinese Patent Application No. 201780020517.9, dated Jul. 3, 12019, with partial English translation (11 pages).

* cited by examiner

BOLTLESS FIXED SCROLL-TO-FRAME JOINT

FIELD

This disclosure relates generally to vapor compression systems. More specifically, the disclosure relates to a scroll compressor in a vapor compression system such as, but not limited to, a heating, ventilation, air conditioning, and refrigeration (HVACR) system.

BACKGROUND

Scroll machines generally include a class of positive fluid displacement apparatuses which use orbiting involute spiral wraps formed on facing parallel plates to compress, expand, or pump a fluid. Scroll machines specifically are directed to scroll-type apparatuses wherein radially compliant means permit actual moving line contact between the flank surfaces of intermeshing wrap elements. Scroll compressors may use several bolts to connect a fixed scroll to an upper main frame of the scroll compressor. The fixed scroll bolts add material cost to the bill of materials, require holes to be drilled and tapped in the scroll and frame, and require cycle time to install on the assembly line. Additionally, use of fixed scroll bolts increase the overall diameter of the compressor due to the diameter of the individual bolts and the minimum required wall thickness adjacent to the bolt holes. Although many designs for scroll machines exist, improved designs and assembly methods to enable easier and faster assembly while reducing costs and quantity of components are desirable.

SUMMARY

For purposes of reducing cost, complexity and diameter of scroll compressor designs, it is desirable to eliminate the fixed scroll bolts used in attaching the fixed scroll to the upper frame.

In a scroll compressor, the joint between the fixed scroll and the upper frame is created by machining matching tapered radially contacting surfaces on each part which, when twisted together, pulls the fixed scroll axially toward the frame, locking it in place. Machining matching, as used in this description, includes machining a contact surface on a first part and machining a surface on a second part, the machining surfaces being designed to correspond or match when mated with each other. In addition, a pressure dome, located above the fixed scroll, clamps the scroll tight against the frame at initial assembly. When the compressor is running, discharge gas pressure acts on the dome to further clamp the fixed scroll in place with sufficient force that fixed scroll bolts may be eliminated, decreasing the overall diameter, weight and cost of the compressor.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout

DETAILED DESCRIPTION

Figure 1:
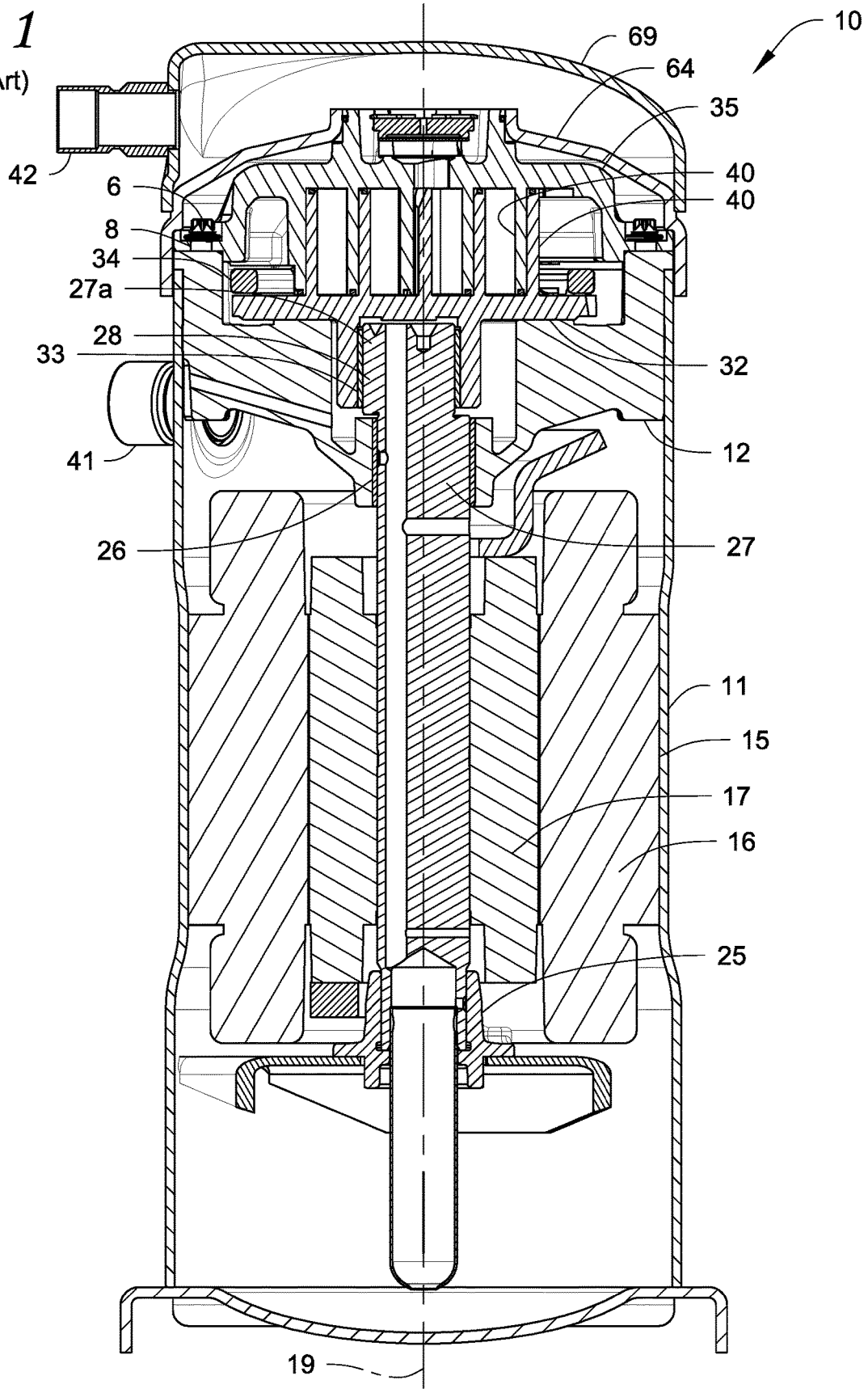
Fig. 1 (Prior Art)
FIG. 1 shows a prior art scroll compressor.

A scroll machine (e.g., a scroll compressor or the like) can include a pair of scroll members which orbit relative to each other to compress a working fluid such as, but not limited to, air or a refrigerant. The scroll compressor includes a first, stationary (non-orbiting) scroll member having a base and a generally spiral wrap extending from the base, and a second, orbiting scroll member having a base and a generally spiral wrap extending from the base. The spiral wraps of the first and second scroll members are intermeshed, creating a series of compression chambers. The scroll compressor also includes a frame to which the stationary scroll is typically fixed via bolts. Embodiments described in this specification are directed to systems and methods for securing the stationary scroll member to the frame in a boltless connection. A boltless connection, which may utilize an intermediate cap to bias the stationary scroll to the frame, can be relatively cheaper and simpler to manufacture than a bolted connection. Further, in an embodiment, the boltless connection can reduce a radial footprint of the scroll compressor.

A scroll machine is generally denoted by reference numeral 10. In the preferred embodiment, the scroll machine 10 is a refrigerant fluid compressor. It will be understood that a scroll machine in accordance with the description in this specification can also be configured for use as a pump or for expanding a gaseous fluid.

Scroll compressor 10 includes a hermetic shell 11 that encloses substantially all the operating mechanism of the device. A frame 12 supports the operating mechanism.

FIG. 1 shows a prior art scroll compressor 10. The scroll compressor 10 includes an electric motor 15 inside the hermetic shell 11. The electric motor 15 includes a stator 16 and a rotor 17. The stator 16 can be press fit or interference fit to the hermetic shell 11. The rotor 17 may typically be press-fit or otherwise assembled to a drive shaft 27. The drive shaft 27 extends along a longitudinal axis 19 of the scroll compressor 10. The drive shaft 27 and the rotor 17 may be supported and centered within the frame 12 and the stator 16 by a lower drive shaft main bearing 25 and an upper drive shaft main bearing 26. The drive shaft main bearings 25 and 26 may be of the plain sleeve bearing type, according to an embodiment.

A drive crank pin 28 can be formed on an upper end 27*a* of the drive shaft 27. The drive crank pin 28 can be radially displaced from and parallel to the longitudinal axis 19 of the drive shaft 27. The drive crank pin 28 connects the drive shaft 27 to an orbiting scroll plate 32 through a bearing 29. Rotation of the drive shaft 27 and the crank pin 28 can thereby draw the scroll plate 32 around in an orbital path having a radius equal to the displacement of the center of drive pin 28 from the longitudinal axis 19 of the drive shaft 27. The principles by which scroll machines such as compressor 10 operate are well known to those skilled in the art and have been explained in numerous prior art U.S. patents, as for example, U.S. Pat. No. 4,065,279, which is incorporated herein by reference.

Axial force may be applied to a lower surface of the orbiting scroll plate 32 by a thrust bearing 33. A face of the thrust bearing 33 can be machined into a top surface of the frame 12.

Orbiting scroll plate 32 is constrained to orbit in a circular path relative to a stationary or fixed scroll plate 35 by means of an Oldham coupling 34. The orbiting and stationary scroll plates 32 and 35, respectively, include involute wrap elements 40 on their facing surfaces. The involute wrap elements 40 define moving pockets of fluid (e.g., a working fluid being compressed) by means of moving line contacts as scroll plate 32 orbits relative to the stationary scroll plate 35. The relative orbital motion of the scroll plates 32 and 35 causes these pockets of fluid to experience a change in volume and pressure as the fluid moves radially inward toward the center of the plates 32, 35. Thus, fluid entering the scroll compressor 10 through an inlet port 41 in the hermetic shell 11 can cool the rotor 17 and the stator 16, be compressed by the orbital motion of the scroll plate 32, and discharged from the hermetic shell 11 through the outlet port 42 that is in fluid communication with the center of the stationary scroll plate 35.

Prior art compressors include bolts 6 clamping the scroll plate 35 to the frame 12. Bolt holes 8 in both the fixed scroll plate 35 and the frame 12 accommodate the bolts 6. The bolts 6 and the bolt holes 8 can increase the diameter of the scroll compressor 10 and increase machining requirements, assembly time, and/or component costs.

Figure 2:
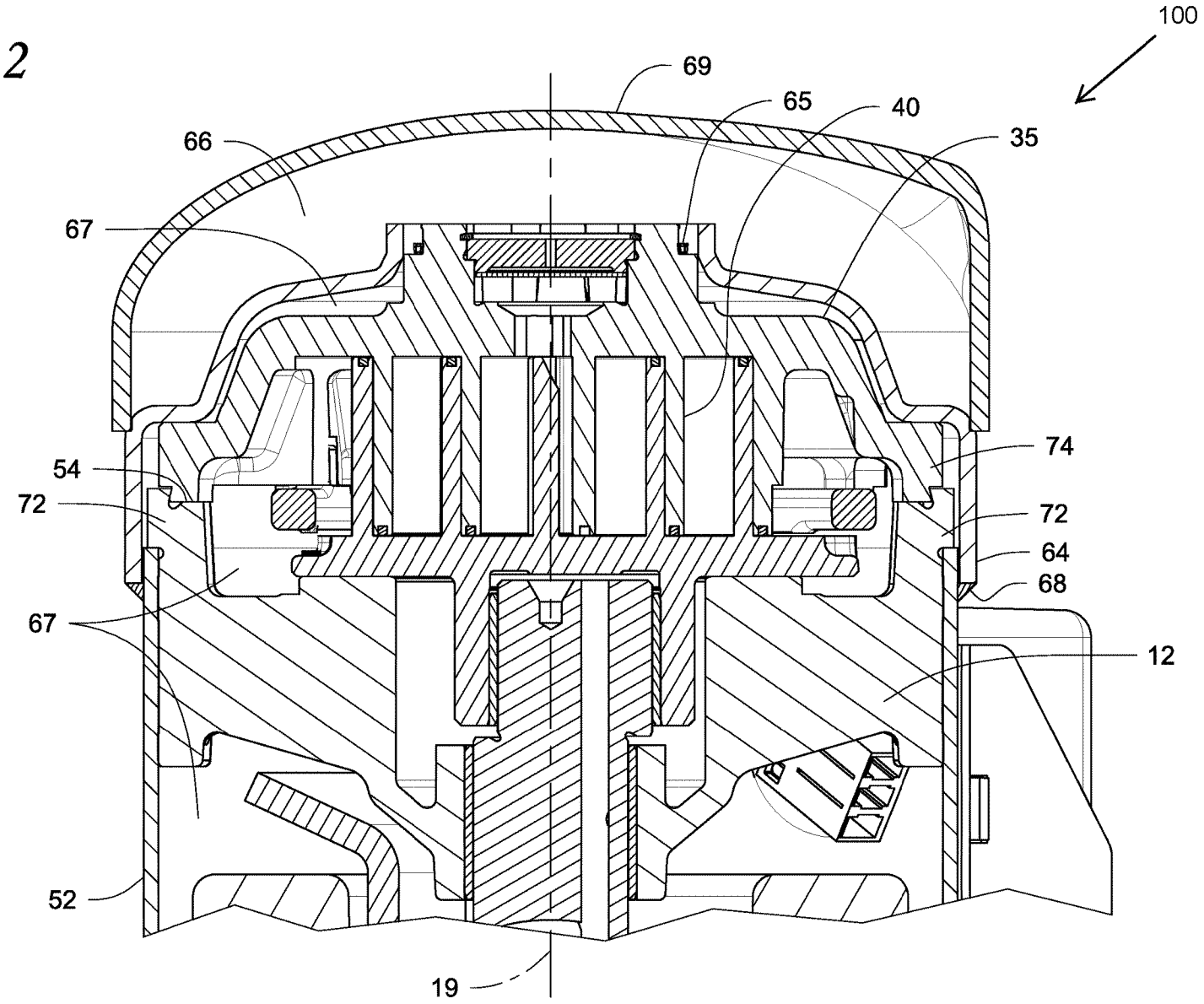
FIG. 2 shows a top section of a scroll compressor modified in accordance with the systems and methods described in this specification, according to an embodiment.
Figure 3:
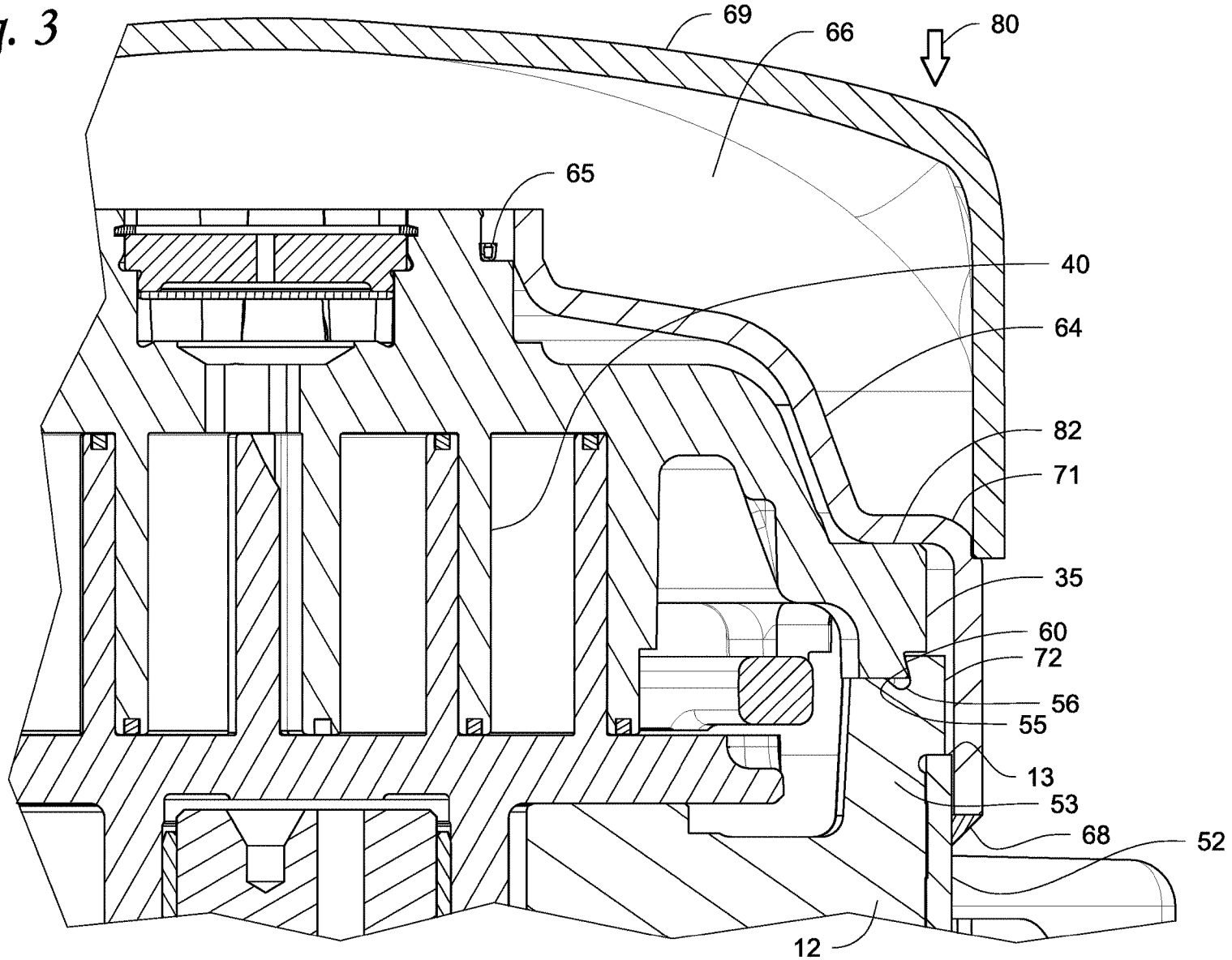
FIG. 3 is shows an enlargement of the right side of FIG. 2, according to an embodiment.

FIGS. 2 and 3 are cross-sectional views of a scroll compressor 100 including a boltless connection clamping the scroll plate to the frame, according to an embodiment. Aspects of the scroll compressor 100 can be the same as or similar to aspects of the scroll compressor 10. For simplicity of this specification, common features are labeled with like reference numbers and are not described in additional detail. In an embodiment, a twist lock mechanism can provide a feature to implement the boltless design. In an embodiment, the twist lock mechanism can simplify an assembly of the scroll compressor 100 and can enable assembly without the use of bolts to clamp the non-orbiting scroll plate 35 to the frame 12 of the scroll compressor 100. The frame 12 is secured (e.g., via a press-fit, interference fit, etc.) in a middle shell 52 of the scroll compressor 100 and can abut against a top edge 13 of the shell 52.

Figure 4:
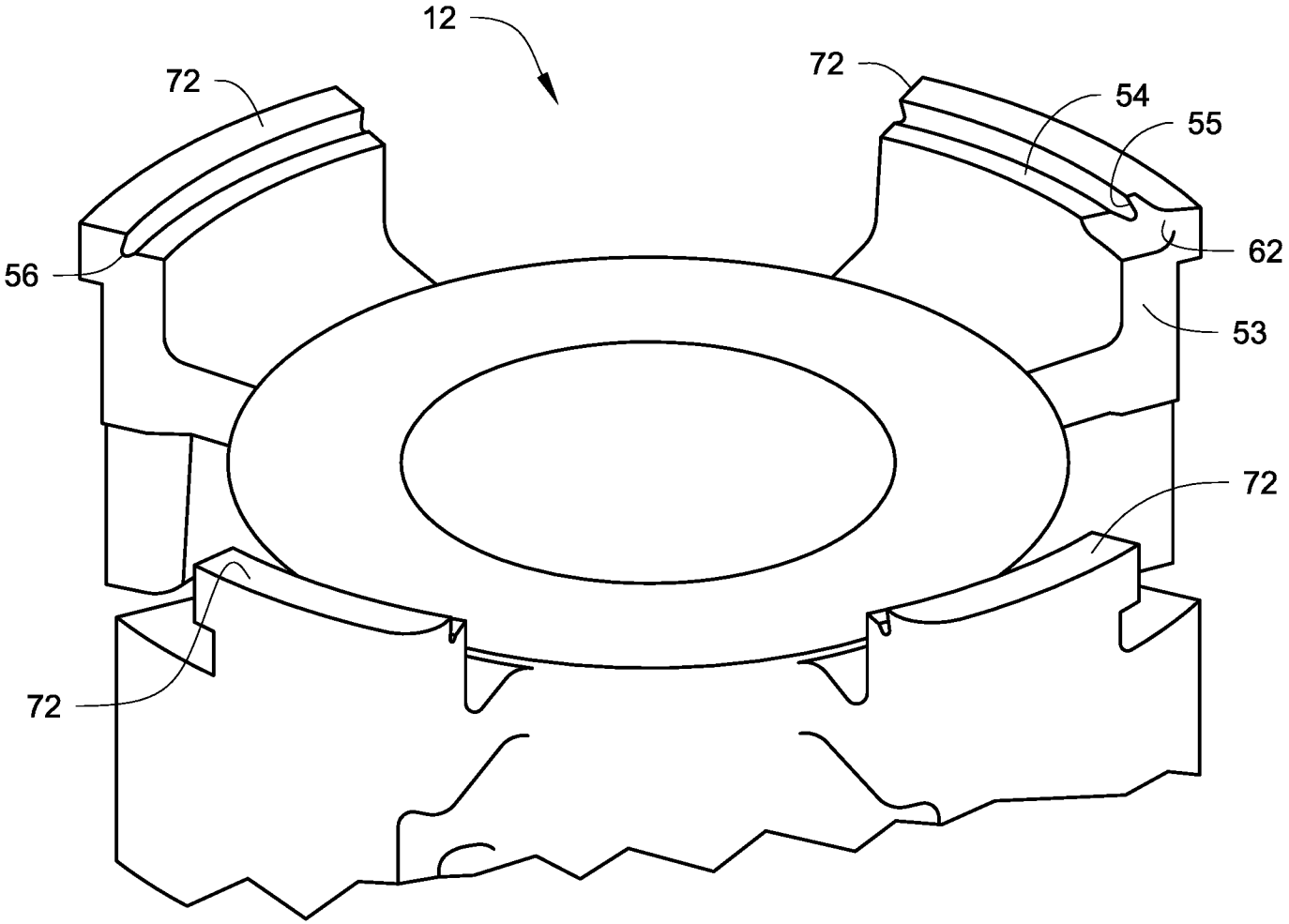
FIG. 4 is a perspective view of the frame, according to an embodiment.

FIG. 4 is a perspective view of the frame 12, according to an embodiment. As shown in FIG. 4, the frame 12 has a plurality of frame extensions 53 which are machined to create a contact surface 54. In an embodiment, the contact surface 54 can be a flat axial contact surface. The frame extensions 53 may alternatively be referred to as the legs 53. In the illustrated embodiment, four frame extensions 53 are shown. It will be appreciated that other numbers of frame extensions 53, such as three or five or even two, can be provided. The frame extensions 53 include an axially extending interlock mechanism 72. The axially extending interlock mechanism 72 can be formed, for example, by machining the frame 12 to create contact surfaces 55 on the frame extensions 53. In an embodiment, the contact surfaces 55 can be inwardly facing, tapered radial contact surfaces 55. In an embodiment, the contact surfaces 55 may be at or about parallel to the axis 19. An undercut 56 can be machined at an intersection of a contact surface 54 and the contact surface 55 to minimize stress in the frame extensions 53 when assembled. In an embodiment, the contact surface 54 may be an axial contact surface.

Figure 5:
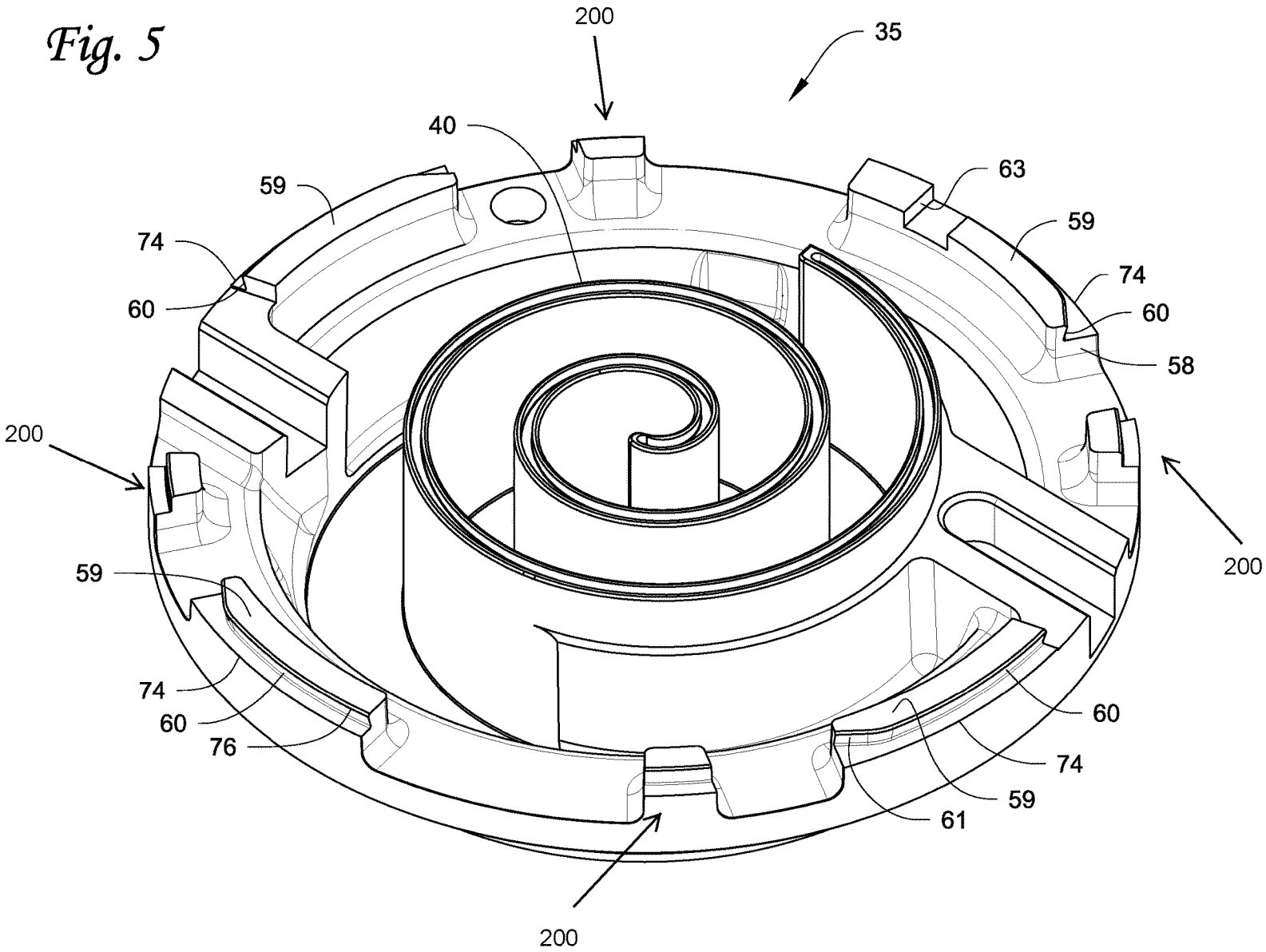
FIG. 5 is a perspective view of the fixed scroll, according to an embodiment.

FIG. 5 is an isometric view of the fixed scroll 35 including a plurality of fixed scroll extensions 74 extending radially from the axis 19, according to an embodiment. The fixed scroll extensions 74 include an axially extending interlock mechanism 76 adapted to engage the frame interlock mechanisms 72 upon radial rotation of the fixed scroll 35. In one embodiment, the fixed scroll 35 includes four cast bosses 58 on an involute side of the fixed scroll 35. In an embodiment, the four cast bosses 58 can be semi-circular cast bosses. An arc length of the bosses 58 is slightly greater than that of the frame extensions 53. The fixed scroll bosses 58 can be machined to create an axial contact surface 59 and an outwardly facing, tapered radial contact surface 60. A radius of the fixed scroll contact surface 60 may be slightly larger than the radius of the contact surface 55 so as to be fitted between the frame 12 and the fixed scroll 35 when assembled. In an embodiment, the fit can be an interference fit or the like. In an embodiment, an angle of the contact surfaces 55 on the frame legs 53 is selected to match an angle of the contact surfaces 60 on the fixed scroll 35. The bosses 58 include a transitional engagement region 61 which can be milled into the radial surface. In an embodiment, the transitional engagement region 61 can have a slightly smaller radius than the contact surface 55 and can transition into the contact surface 60. The fixed scroll 35 can include a plurality of guides 200. The guides 200 can, for example, provide alignment assistance when assembling the scroll compressor 100.

Figure 6:
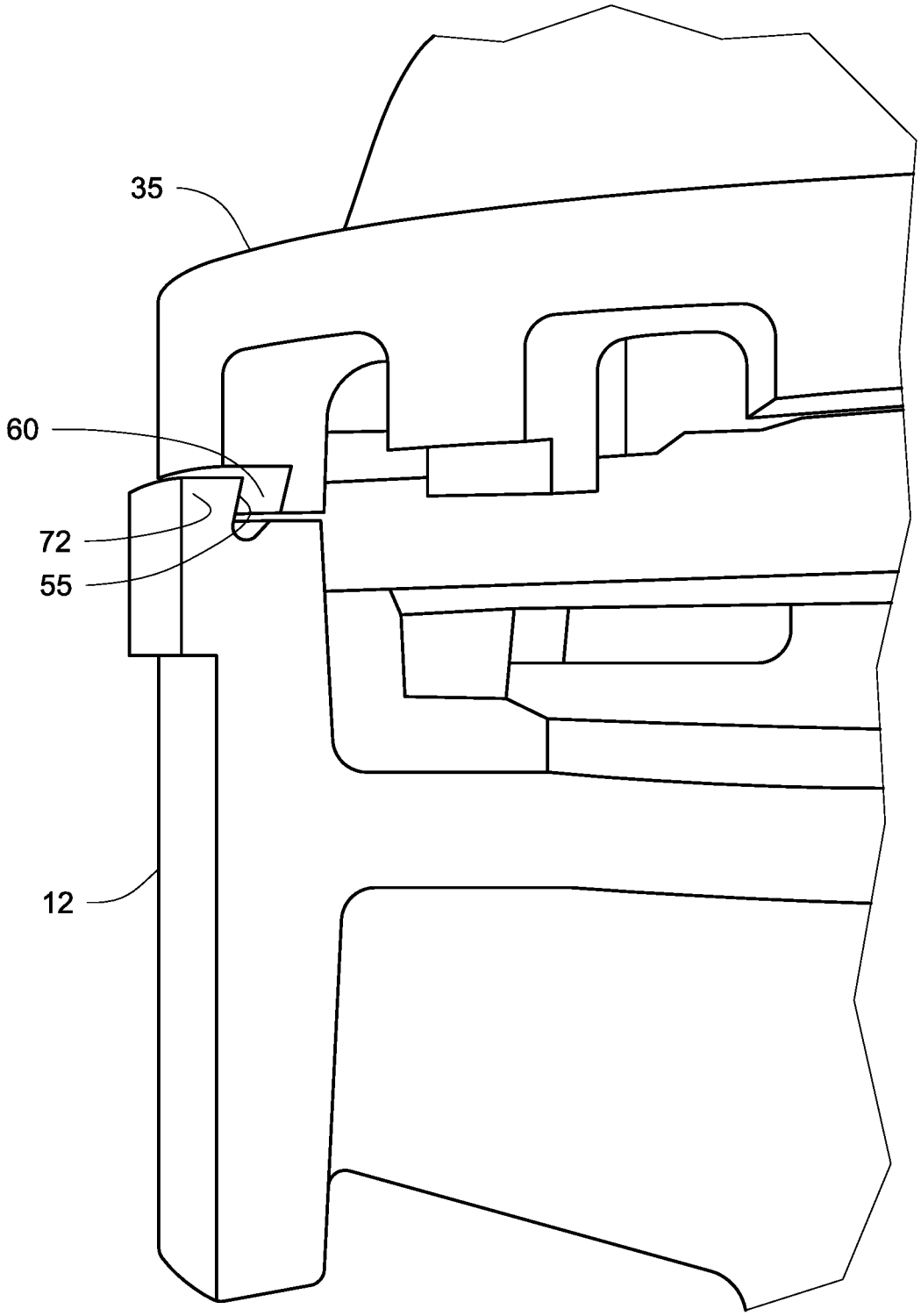
FIG. 6 is a perspective view of the fixed scroll extension and the frame extension in the process of engaging, according to an embodiment.
Figure 7:
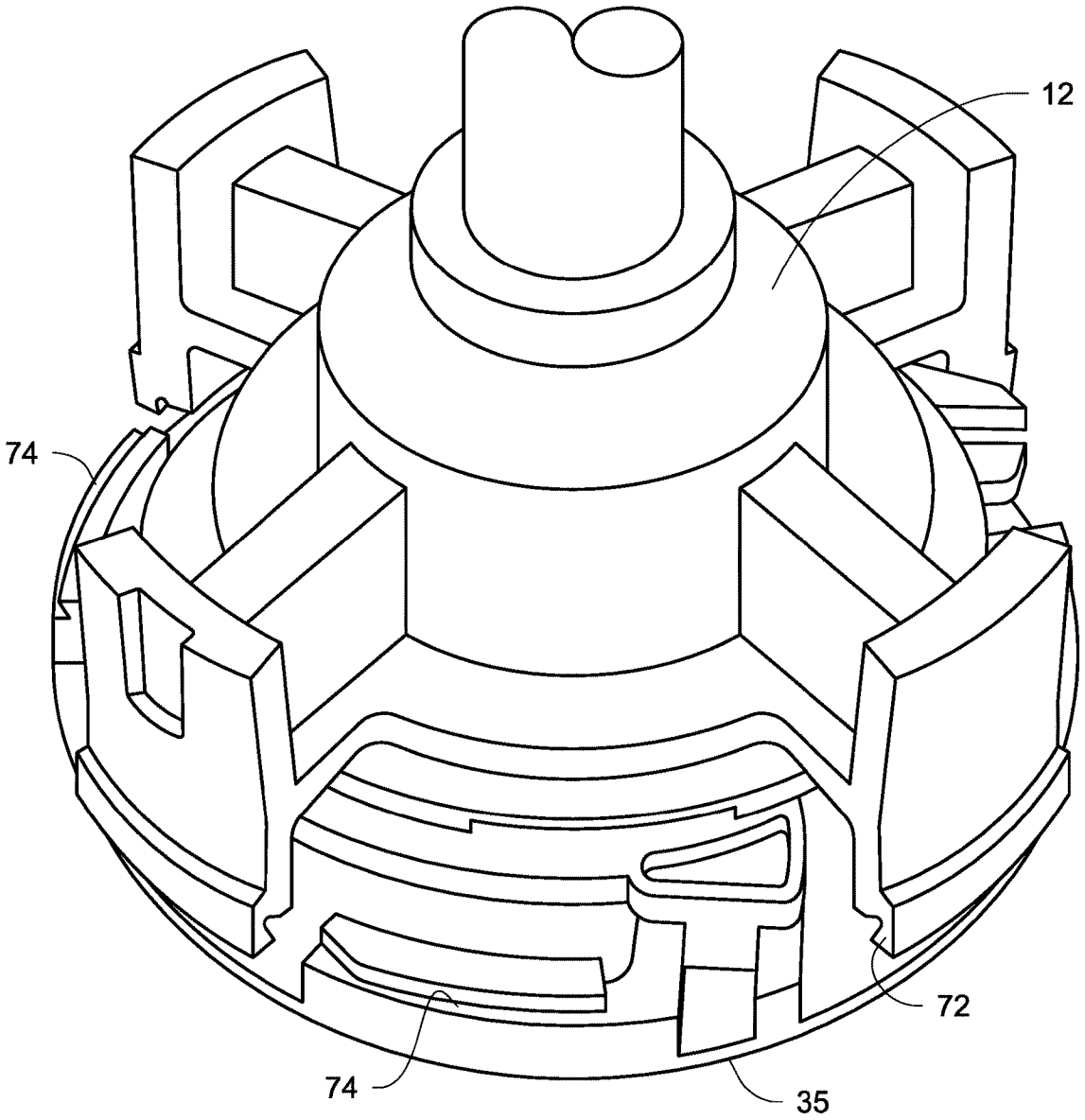
FIG. 7 is a perspective view in an axial direction of the fixed scroll extension and the frame extension prior to rotation, according to an embodiment.
Figure 8:
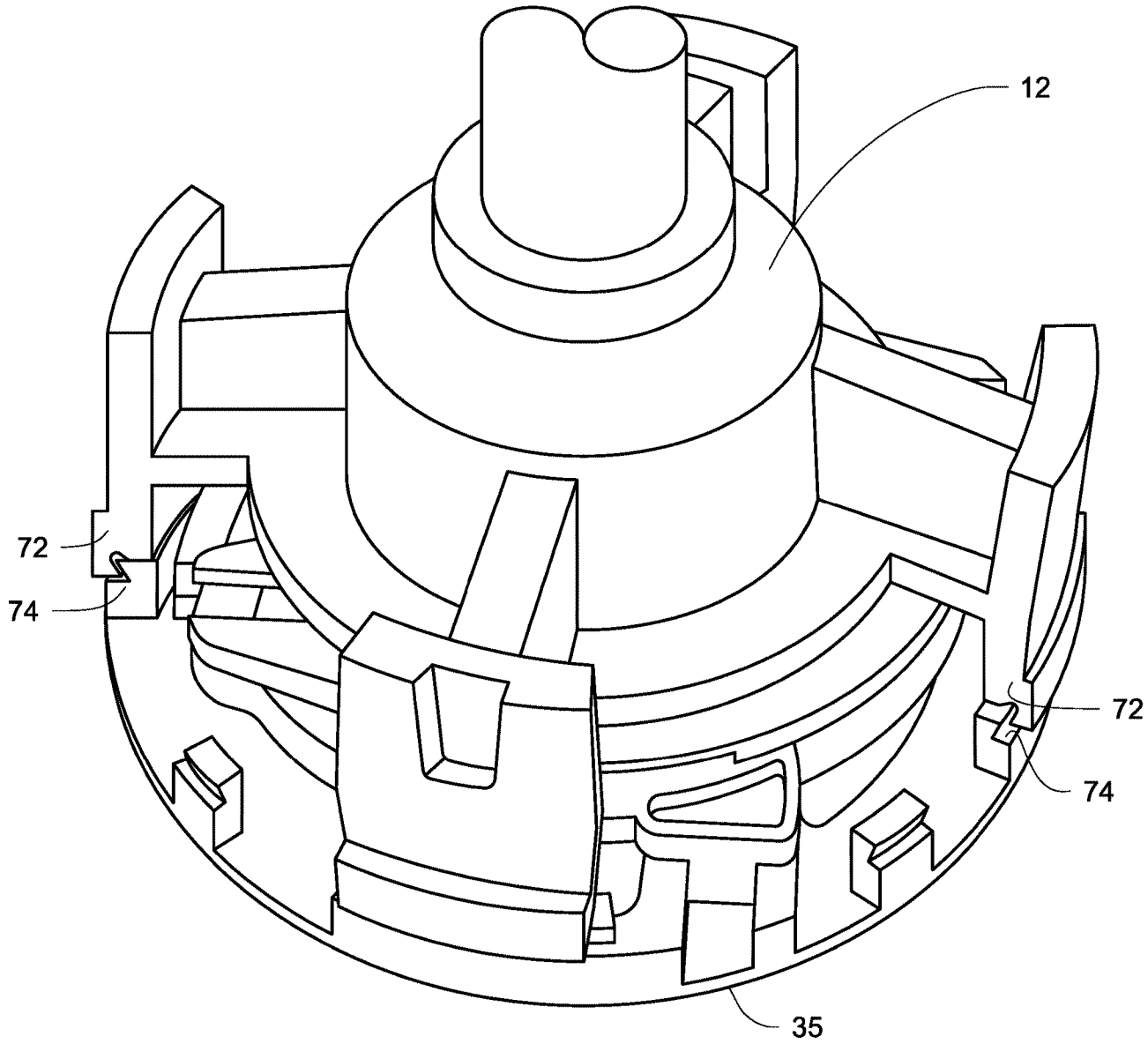
FIG. 8 is a perspective view in an axial direction of the fixed scroll extension and the frame extension after rotation and engagement, according to an embodiment.

When assembling the fixed scroll 35 onto the frame 12, as can be seen in FIGS. 6-8, the bosses 58 can be first positioned, or clocked, between the frame extensions 53 with approximately 45° spacing. The fixed scroll 35 can rest on the axial contact surfaces 54 prior to final assembly. The transitional engagement region 61 on the bosses 58 can slip inside the contact surfaces 55 of the frame 12 to pilot the scroll and ensure it is centered. To complete the fixed scroll assembly, the fixed scroll 35 can be rotated about axis 19 with respect to the frame 12 approximately 45° until cast anti-rotation stop surface 62 on the frame 12 contacts a mating machined anti-rotation stop surface 63 of the fixed scroll 35. An amount of rotation may depend, for example, on a length of the inter-meshing contact surfaces 54, 55 and the number of frame extensions 53. During operation of the scroll compressor 100, the torque on the fixed scroll 35 due to gas pressures in the involute pockets can maintain the fixed scroll 35 securely against the anti-rotation stop on the frame 12, preventing the fixed scroll 35 from twisting loose.

Thus at least one of the frame interlock mechanisms 72 has contact surfaces 54, 55 having a radial and an axial slope, at least one of the fixed scroll support interlock mechanisms 76 has contact surfaces 59, 60 having a radial and an axial slope, and the contact surfaces 54, 55 of the frame interlock mechanism 72 can engage the contact surfaces 59, 60 of the fixed scroll support interlock mechanism 76 upon radial rotation. The radial slope ranges between 0 and 90 degrees, and preferably ranges between 5 and 30 degrees from the vertical. In an embodiment, the contact surfaces 54, 55 or the contact surfaces 59, 60 can also be collectively referred to as engagement surfaces.

The contact surfaces 54, 55 of the frame interlock mechanism 72 and the contact surfaces 59, 60 of the fixed scroll support interlock mechanism 72 are non-planar, such that the non-planar contact surfaces 54, 55 of the frame interlock mechanism 72 and the non-planar contact surfaces 59, 60 of the fixed scroll support interlock mechanism 76 are arced about the axis 19.

Because the contact surfaces 55, 60 are tapered and fitted together, when the fixed scroll 35 is assembled, a component of the contact forces acts in a downward direction 80 and pulls the fixed scroll 35 tight against the frame 12. Structural analysis of one embodiment shows that at or about 1500 lb. the axial load can be generated with at or about 0.002" radial interference fit in the tapered joints and a taper angle of at or about 15° from vertical.

As shown in FIGS. 2 and 3, a drawn steel intermediate cap 64 is assembled over the fixed scroll 35 and stops against the scroll backside, contacting over an annular region 82. A radial lip seal 65 between the neck of the intermediate cap 64 and the fixed scroll 35 separates the high pressure discharge 66 and low pressure suction 67 sides of the compressor 10. When making the intermediate cap weld 68, an external axial force is first applied through the upper cap 69 to deflect the outside diameter of the intermediate cap 64 downward in direction 80 and further clamp the fixed scroll 35 against the frame 12. The diameter of the contact band between the cap 64 and the fixed scroll 35 is sized so that a line of action of contact forces are generally centered on the width of the frame legs 53, ensuring that no bending moment is applied to the fixed scroll 35 in order to keep scroll distortion to a minimum. The intermediate cap 64, when joined to the upper cap 66 and sealed to the fixed scroll with seal 65, creates a discharge pressure region through which gas flows after exiting the fixed scroll port/center and prior to flowing thru the outlet port 42.

The intermediate cap 64 is designed with a flat annular section near the outer diameter where it joins the skirt of the cap 64 in a near 90° bend 71. So constructed, the cap 64 is not stiff in the axial direction and, when the compressor 10 is running, the majority of the pressure forces acting on the cap 64 are bore against the fixed scroll 35, adding further to the clamp loads keeping the fixed scroll 35 in place.

One embodiment includes at least three fixed scroll support extensions 74 and at least three frame extensions 72.

In an embodiment, the scroll compressor includes an orbital scroll plate 34 having an attached involute wrap element 40 in intermeshed relationship with the wrap 40 of the fixed scroll 35. The contact surfaces 54, 55 of the frame interlock mechanism and the contact surfaces 59, 60 of the fixed scroll support interlock mechanism are arced about the axis, engagement of the frame interlock mechanism 72 with the fixed scroll support interlock mechanism 76 biases the frame 12 and the fixed scroll 35 axially towards each other, and the radial slope ranges between 40 and 60 degrees.

The intermediate cap 64 can be assembled over the fixed scroll 35 on a side of the fixed scroll support axially removed from the frame 12, the intermediate cap 64 contacting an annular region 82 of the fixed scroll 35 to bias the fixed scroll 35 against the frame 12.

At least one of the frame interlock mechanisms 72 has contact surfaces 54, 55 having a radially varying diameter, and the contact surfaces 54, 55 of the frame interlock mechanism 72 contacts the contact surfaces 59, 60 of the fixed scroll support interlock mechanism 76 upon radial rotation.

A person of skill in the art will recognize that the arrangement can be reversed or inverted. In these variations, the contact surfaces 59, 60 of the fixed scroll support interlock mechanism 76 has one of a fixed radial diameter, an increasing radial diameter, or a decreasing radial diameter; the radially varying diameter of the frame interlock mechanism 72 is either an increasing radial diameter or a decreasing radial diameter. Similarly, the fixed scroll support interlock mechanism 74 has contact surfaces 59, 60 having a radially varying diameter, and the contact surfaces 54, 55 of the frame interlock mechanism 72 contacts the contact surfaces 59, 60 of the fixed scroll support interlock mechanism 76 upon radial rotation. Variations include the contact surfaces 54, 55 of the frame interlock mechanism 72 has one of a fixed radial diameter, an increasing radial diameter, or a decreasing radial diameter, and the radially varying diameter of the fixed scroll support interlock mechanism 76 is either an increasing radial diameter or a decreasing radial diameter.

A person of skill in the art will recognize that the diameters of the contact surfaces can be varied, such that the contact surfaces 59, 60 of the fixed scroll support interlock mechanism 76 has one of a fixed axial diameter, an increasing axial diameter, or a decreasing axial diameter, and the axially varying diameter of the frame interlock mechanism 72 is either an increasing axial diameter or a decreasing axial diameter.

The scroll compressor 100 can be assembled according to the following:

aligning the frame 12 about the axis 19;

(ii) providing, on the frame 12, the plurality of frame extensions 53 extending radially from the axis 19;

(iii) providing the axially extending interlock mechanism 72 on each frame extension 53;

(iv) providing the fixed scroll 35 aligned about the axis 19;

(v) providing the plurality of extensions 74 extending radially from the axis 19 on the fixed scroll 35;

(vi) providing the axially extending interlock mechanism 76 adapted to engage one of the frame interlock mechanisms 72 upon radial rotation; and (vii) radially rotating either the frame 12 or the fixed scroll 35 so as to engage the fixed scroll support interlock mechanism 74 with the frame interlock mechanism 72.

The method of assembly may also include:

(viii) providing at least one of the frame interlock mechanism 72 with the contact surfaces 54, 55 having a radial and an axial slope; and (ix) providing at least one of the fixed scroll support interlock mechanism 74 with the contact surfaces 59, 60 having a radial and an axial slope.

Engaging the contact surfaces 59, 60 of the fixed scroll support interlock mechanism 76 with the contact surfaces 54, 55 of the frame interlock mechanism 72 upon radial rotation can be planar, or the contact surfaces 54, 55 of the frame interlock mechanism 72 and the contact surfaces 59, 60 of the fixed scroll support interlock mechanism 76 can be non-planar and arced about the axis 19.

A method of biasing a scroll compressor assembly together without bolts or the like includes: (a) providing a frame 12 including a plurality of frame extensions 53 extending radially from an axis 19 and an axially extending interlock mechanism 72 on each frame extension; (b) providing a fixed scroll support 35 including a fixed scroll wrap 40, a plurality of extensions 74 extending radially from the axis 19 and an axially extending interlock mechanism 76 on each fixed scroll support extension 74; (c) providing an orbital scroll plate 33 having an attached involute wrap element 40 in intermeshed relationship with the fixed scroll wrap 35; and (d) engaging the frame interlock mechanism 72 with the fixed scroll support interlock mechanism 76 to provide a first pressure biasing the frame 12 and the fixed scroll support axially towards each other.

In an embodiment, the method can further include: (e) providing an intermediate cap 64 assembled over the fixed scroll 35 on a side of the fixed scroll support axially removed from the frame 12; and (f) contacting an annular region 82 of the fixed scroll support with the intermediate cap 64 and to provide a second pressure biasing the fixed scroll 35 against the frame 12.

In an embodiment, the method can further include: (g) operating the scroll compressor 100 assembly to provide a third pressure on a discharge side 66 of the intermediate cap 64 biasing the fixed scroll 35 against the frame 12.

It should be noted that the above description is for a frame and scroll design that has four legs and bosses, respectively. This arrangement can provide for optimal packaging of the orbiting scroll and Oldham coupling (not shown). It will be appreciated that the twist lock feature can also work with a "three-legged" design or with a multi-legged design. Further, the direction of the tapered radial contact surfaces can be switched. For example, the contact surface on the frame could face radially outward and the contact surface on the fixed scroll could face radially inward. The angle on the tapered surfaces, however, is preferably set in a dovetail arrangement so that when the surfaces are engaged the fixed scroll is pulled toward the frame.

It will be appreciated that although the features above are described with respect to a gas compressor, the principles described could alternatively be implemented in a scroll-type fluid apparatus of other types, such as liquid pumps, expansion engines, or the like. In the case of an electric motor-driven compressor, speed variations may be brought about through the use of, for example, variable speed drives. It is contemplated, however, the principles described in this specification would also have utility in applications where a variable speed prime mover (e.g., an internal combustion engine, etc.) is used to drive a compressor, such as in an automobile or bus air conditioning system.

Aspects:

Any one of aspects 1-23 can be combined with any one of aspects 24-27, 28-30, 31-41, 42-43, and 44-45. Any one of aspects 24-27 can be combined with any one of aspects 28-30, 31-41, 42-43, and 44-45. Any one of aspects 28-30 can be combined with any one of aspects 31-41, 42-43, and 44-45. Any one of aspects 31-41 can be combined with any one of aspects 42-43 and 44-45. Any one of aspects 42-43 can be combined with any one of aspects 44-45.

Aspect 1. A scroll compressor comprising:

a frame aligned about an axis, the frame including a plurality of extensions extending radially from the axis, each extension including an axially extending interlock mechanism; a fixed scroll support aligned about the axis, the fixed scroll support including a plurality of extensions extending radially from the axis, each extension including an axially extending interlock mechanism adapted to engage one of the frame interlock mechanisms upon radial rotation; and a fixed scroll wrap integral with or attached to the fixed scroll support.

Aspect 2. The scroll compressor of aspect 1, wherein at least one of the frame interlock mechanisms has an engagement surface having a radial and an axial slope, wherein at least one of the fixed scroll support interlock mechanisms has an engagement surface having a radial and an axial slope, and wherein the engagement surface of the frame interlock mechanism engages the engagement surface of the fixed scroll support interlock mechanism upon radial rotation.

Aspect 3. The scroll compressor of aspect 2, including at least three fixed scroll support extensions and at least three frame extensions.

Aspect 4. The scroll compressor of aspect 2, wherein the radial slope ranges between 0 and 90 degrees.

Aspect 5. The scroll compressor of aspect 4, wherein the radial slope ranges between 5 and 30 degrees.

Aspect 6. The scroll compressor of aspect 2, wherein the engagement surface of the frame interlock mechanism and the engagement surface of the fixed scroll support interlock mechanism are non-planar.

Aspect 7. The scroll compressor of aspect 6, wherein the non-planar engagement surface of the frame interlock mechanism and the non-planar engagement surface of the fixed scroll support interlock mechanism are arced about the axis.

Aspect 8. The scroll compressor of any one of aspects 1-7, further including an orbital scroll plate having an attached involute wrap element in intermeshed relationship with the fixed scroll wrap, wherein the engagement surface of the frame interlock mechanism and the engagement surface of the fixed scroll support interlock mechanism are arced about the axis, wherein engagement of the frame interlock mechanism with the fixed scroll support interlock mechanism biases the frame and the fixed scroll support axially towards each other, and wherein the radial slope ranges between 0 and 90 degrees.

Aspect 9. The scroll compressor of any one of aspects 1-8, wherein engagement of the frame interlock mechanism with the fixed scroll support interlock mechanism biases the frame and the fixed scroll support axially towards each other.

Aspect 10. The scroll compressor of aspect 9, further including an intermediate cap assembled over the fixed scroll on a side of the fixed scroll support axially removed from the frame, the intermediate cap contacting an annular region of the fixed scroll support to bias the fixed scroll against the frame.

Aspect 11. The scroll compressor of any one of aspects 1-10, wherein at least one of the frame interlock mechanisms has an engagement surface having a radially varying diameter, and wherein the engagement surface of the frame interlock mechanism contacts the engagement surface of the fixed scroll support interlock mechanism upon radial rotation.

Aspect 12. The scroll compressor of aspect 11, wherein the engagement surface of the fixed scroll support interlock mechanism has one of a fixed radial diameter, an increasing radial diameter, or a decreasing radial diameter.

Aspect 13. The scroll compressor of aspect 11, wherein the radially varying diameter of the frame interlock mechanism is either an increasing radial diameter or a decreasing radial diameter.

Aspect 14. The scroll compressor of any one of aspects 1-13, wherein the fixed scroll support interlock mechanism has an engagement surface having a radially varying diameter, and wherein the engagement surface of the frame interlock mechanism contacts the engagement surface of the fixed scroll support interlock mechanism upon radial rotation.

Aspect 15. The scroll compressor of aspect 14, wherein the engagement surface of the frame interlock mechanism has one of a fixed radial diameter, an increasing radial diameter, or a decreasing radial diameter.

Aspect 16. The scroll compressor of aspect 14, wherein the radially varying diameter of the fixed scroll support interlock mechanism is either an increasing radial diameter or a decreasing radial diameter.

Aspect 17. The scroll compressor of any one of aspects 1-16, wherein the fixed scroll support interlock mechanism radially rotates in a first direction to engage with the frame interlock mechanism, and further including a shaft co-linear with the axis and rotatable thereabout, wherein the direction of shaft rotation is in the first direction.

Aspect 18. The scroll compressor of any one of aspects 1-17, wherein at least one of the frame interlock mechanisms has an engagement surface having an axially varying diameter, and wherein the engagement surface of the frame interlock mechanism contacts the engagement surface of the fixed scroll support interlock mechanism upon axial rotation.

Aspect 19. The scroll compressor of aspect 18, wherein the engagement surface of the fixed scroll support interlock mechanism has one of a fixed axial diameter, an increasing axial diameter, or a decreasing axial diameter.

Aspect 20. The scroll compressor of aspect 18, wherein the axially varying diameter of the frame interlock mechanism is either an increasing axial diameter or a decreasing axial diameter.

Aspect 21. The scroll compressor of any one of aspects 1-20, wherein the fixed scroll support interlock mechanism has an engagement surface having an axially varying diameter, and wherein the engagement surface of the frame interlock mechanism contacts the engagement surface of the fixed scroll support interlock mechanism upon axial rotation.

Aspect 22. The scroll compressor of aspect 21, wherein the engagement surface of the frame interlock mechanism has one of a fixed axial diameter, an increasing axial diameter, or a decreasing axial diameter.

Aspect 23. The scroll compressor of aspect 21, wherein the axially varying diameter of the fixed scroll support interlock mechanism is either an increasing axial diameter or a decreasing axial diameter.

Aspect 24. A method of assembling a scroll compressor, comprising:

aligning a frame about an axis;

providing, on the frame, a plurality of frame extensions extending radially from the axis;

providing an axially extending interlock mechanism on each frame extension;

providing a fixed scroll support aligned about the axis;

providing a plurality of extensions extending radially from the axis on the fixed scroll support; providing an axially extending interlock mechanism adapted to engage one of the frame interlock mechanisms upon radial rotation; and radially rotating either the frame or the fixed scroll support so as to engage the fixed scroll support interlock mechanism with the frame interlock mechanism.

Aspect 25. The method of aspect 24, further comprising:

providing at least one of the frame interlock mechanism with an engagement surface having a radial and an axial slope; and providing at least one of the fixed scroll support interlock mechanism with an engagement surface having a radial and an axial slope.

Aspect 26. The method of aspect 25, wherein the engagement surface of the frame interlock mechanism engages the engagement surface of the fixed scroll support interlock mechanism upon radial rotation.

Aspect 27. The method of aspect 26, wherein the engagement surface of the frame interlock mechanism and the engagement surface of the fixed scroll support interlock mechanism are non-planar and are arced about the axis.

Aspect 28. A method of biasing a scroll compressor assembly together without bolts or the like, comprising:

providing a frame including a plurality of frame extensions extending radially from an axis and an axially extending interlock mechanism on each frame extension;

providing a fixed scroll support including a fixed scroll wrap, a plurality of extensions extending radially from the axis and an axially extending interlock mechanism on each fixed scroll support extension;

providing an orbital scroll plate having an attached involute wrap element in intermeshed relationship with the fixed scroll wrap; and engaging the frame interlock mechanism with the fixed scroll support interlock mechanism to provide a first pressure biasing the frame and the fixed scroll support axially towards each other.

Aspect 29. The method of aspect 28, further comprising:

providing an intermediate cap assembled over the fixed scroll on a side of the fixed scroll support axially removed from the frame;

contacting an annular region of the fixed scroll support with the intermediate cap and to provide a second pressure biasing the fixed scroll against the frame.

Aspect 30. The method of aspect 29, further comprising:

operating the scroll compressor assembly to provide a third pressure on a discharge side of the intermediate cap biasing the fixed scroll against the frame.

Aspect 31. A scroll compressor, comprising:

a shell;

a frame aligned about a longitudinal axis of the scroll compressor, the frame being fitted into the shell;

a fixed scroll having a fixed scroll wrap and a fixed scroll support, wherein the fixed scroll support is aligned about the longitudinal axis and is secured to the frame in a boltless connection; and an intermediate cap engaging with a surface of the fixed scroll support on an opposite side of the fixed scroll wrap, the intermediate cap being secured to the shell and contacting an annular region of the fixed scroll support to bias the fixed scroll against the frame.

Aspect 32. The scroll compressor of aspect 31, wherein the frame includes a plurality of extensions extending radially from the longitudinal axis, the plurality of extensions including axially extending frame interlock mechanisms; and the fixed scroll support includes a plurality of extensions extending radially from the longitudinal axis, the plurality of extensions including axially extending fixed scroll support interlock mechanisms configured to engage the frame interlock mechanisms upon radial rotation.

Aspect 33. The scroll compressor of aspect 32, wherein at least one of the plurality of frame interlock mechanisms includes an engagement surface having a radial and an axial slope, wherein at least one of the plurality of fixed scroll support interlock mechanisms has an engagement surface having a radial and an axial slope, and wherein the engagement surface of the frame interlock mechanism engages the engagement surface of the fixed scroll support interlock mechanism upon radial rotation.

Aspect 34. The scroll compressor of aspect 33, wherein the scroll compressor includes at least three fixed scroll support extensions and at least three frame extensions.

Aspect 35. The scroll compressor of any one of aspects 33-34, wherein the radial slope ranges between 0 and 90 degrees.

Aspect 36. The scroll compressor of aspect 35, wherein the radial slope ranges between 5 and 30 degrees.

Aspect 37. The scroll compressor of any one of aspects 33-36, wherein the engagement surface of the at least one frame interlock mechanism and the engagement surface of the at least one fixed scroll support interlock mechanism are non-planar.

Aspect 38. The scroll compressor of aspect 37, wherein the non-planar engagement surface of the at least one frame interlock mechanism and the non-planar engagement surface of the at least one fixed scroll support interlock mechanism are arced about the longitudinal axis.

Aspect 39. The scroll compressor of any one of aspects 32-39, wherein engagement of the plurality of frame interlock mechanisms with the plurality of fixed scroll support interlock mechanisms biases the frame and the fixed scroll support axially towards each other.

Aspect 40. The scroll compressor of aspect 39, further comprising:

an intermediate cap assembled over the fixed scroll on a side of the fixed scroll support axially removed from the frame, the intermediate cap contacting an annular region of the fixed scroll support to bias the fixed scroll against the frame.

Aspect 41. The scroll compressor of any one of aspects 32-40, wherein at least one of the plurality of frame interlock mechanisms has an engagement surface having a radially varying diameter, and the engagement surface of the at least one of the plurality of frame interlock mechanisms contacts an engagement surface of at least one of the plurality of fixed scroll support interlock mechanisms upon radial rotation.

Aspect 42. A method of assembling a scroll compressor, comprising:

aligning a frame about an axis;

fitting the frame within an shell of the scroll compressor to secure the frame; and securing a fixed scroll support to the frame in a boltless connection by biasing an intermediate cap such that the fixed scroll support is secured between the intermediate cap and the frame.

Aspect 43. The method of aspect 42, wherein the frame includes a plurality of frame extensions extending radially from the axis, the plurality of frame extensions including an axially extending interlock mechanism; the fixed scroll support includes a plurality of extensions extending radially from the axis, the plurality of fixed scroll support extensions including a radially extending interlock mechanism;

wherein the securing further comprises radially rotating either the frame or the fixed scroll support to engage the fixed scroll support interlock mechanism with the frame interlock mechanism.

Aspect 44. A method of biasing a scroll compressor assembly together without bolts or the like, comprising:

aligning a frame about an axis;

fitting the frame within a shell of the scroll compressor to secure the frame; and securing a fixed scroll support to the frame in a boltless connection by engaging a frame interlock mechanism with a fixed scroll support interlock mechanism to provide a first pressure biasing the frame and the fixed scroll support towards each other; and by biasing an intermediate cap such that the fixed scroll support is secured between the intermediate cap and the frame.

Aspect 45. The method of aspect 44, wherein biasing the intermediate cap includes contacting an annular region of the fixed scroll support with the intermediate cap; and supplying a second pressure biasing the fixed scroll against the frame via the intermediate cap.

What is claimed is:

1. A method of assembling a scroll compressor, comprising:

aligning a frame about an axis of the scroll compressor;

fitting the frame within a shell of the scroll compressor to secure the frame;

securing a fixed scroll support of a fixed scroll to the frame in a boltless connection by biasing an intermediate cap such that the fixed scroll support is secured between the intermediate cap and the frame; and securing an upper cap over a top of the intermediate cap, wherein the scroll compressor includes an orbiting scroll, the frame includes a plurality of extensions including an axially extending frame interlock mechanism and the fixed scroll support includes a plurality of extensions including an axially extending fixed scroll support interlock mechanism, wherein securing the fixed scroll support of the fixed scroll to the frame further comprises engaging the fixed scroll support interlock mechanism with the frame interlock mechanism.

2. The method of claim 1, wherein the plurality of extensions of the frame extends radially from the axis; and the plurality of extensions of the fixed scroll support extends radially from the axis of the scroll compressor.

3. The method of claim 1, wherein securing the fixed scroll support of the fixed scroll to the frame further comprises radially rotating either the frame or the fixed scroll support to engage the fixed scroll support interlock mechanism with the frame interlock mechanism.

4. A method of biasing a scroll compressor assembly together without bolts, comprising:

aligning a frame about an axis of the scroll compressor;

fitting the frame within a shell of the scroll compressor to secure the frame;

securing a fixed scroll support of a fixed scroll to the frame in a boltless connection by engaging an axially extending frame interlock mechanism with an axially extending fixed scroll support interlock mechanism to provide a first pressure biasing the frame and the fixed scroll support towards each other, the scroll compressor including an orbiting scroll, the frame including a plurality of extensions including the axially extending frame interlock mechanism, and the fixed scroll support including a plurality of extensions including the axially extending fixed scroll support interlock mechanism;

securing the fixed scroll support to the frame by biasing an intermediate cap such that the fixed scroll support is secured between the intermediate cap and the frame; and securing an upper cap over a top of the intermediate cap, wherein in operation, a discharge pressure on the intermediate cap provides a biasing pressure to maintain the intermediate cap, fixed scroll support, and the frame in a secured configuration.

5. The method of claim 4, wherein biasing the intermediate cap includes contacting an annular region of the fixed scroll support with the intermediate cap; and supplying a second pressure biasing the fixed scroll against the frame via the intermediate cap.

6. The method of claim 4, wherein securing the fixed scroll support of the fixed scroll to the frame in the boltless connection by engaging the axially extending frame interlock mechanism with the axially extending fixed scroll support interlock mechanism to provide the first pressure biasing the frame and the fixed scroll support towards each other is via rotation.

7. A scroll compressor, comprising:

a shell;

a frame aligned about a longitudinal axis of the scroll compressor, the frame being fitted into the shell, wherein the frame includes a plurality of extensions including axially extending frame interlock mechanisms;

an orbiting scroll;

a fixed scroll having a fixed scroll wrap and a fixed scroll support, wherein the fixed scroll support is aligned about the longitudinal axis and is secured to the frame in a boltless connection, the fixed scroll support includes a plurality of extensions including axially extending fixed scroll support interlock mechanisms configured to engage the frame interlock mechanisms;

an intermediate cap engaging with a surface of the fixed scroll support on an opposite side of the fixed scroll wrap, the intermediate cap being secured to the shell and contacting an annular region of the fixed scroll support to bias the fixed scroll against the frame; and an upper cap secured over a top of the intermediate cap.

8. The scroll compressor of claim 7, wherein the a plurality of extensions of the frame extends radially from the longitudinal axis of the scroll compressor; and the plurality of extensions of the fixed scroll support extends radially from the longitudinal axis of the scroll compressor.

9. The scroll compressor of claim 8, wherein at least one of the plurality of frame interlock mechanisms includes an engagement surface having a radial and an axial slope, wherein at least one of the plurality of fixed scroll support interlock mechanisms has an engagement surface having a radial and an axial slope, and wherein the engagement surface of the at least one of the plurality of the frame interlock mechanisms engages the engagement surface of the at least one of the plurality of the fixed scroll support interlock mechanisms upon radial rotation.

10. The scroll compressor of claim 9, wherein the plurality of extensions of the fixed scroll support includes at least three extensions and the plurality of extensions of the frame includes at least three extensions.

11. The scroll compressor of claim 9, wherein the radial slope ranges between 0 and 90 degrees.

12. The scroll compressor of claim 11, wherein the radial slope ranges between 5 and 30 degrees.

13. The scroll compressor of claim 9, wherein the engagement surface of the at least one of the plurality of frame interlock mechanisms and the engagement surface of the at least one of the plurality of fixed scroll support interlock mechanisms are non-planar.

14. The scroll compressor of claim 13, wherein the non-planar engagement surface of the at least one of the plurality of frame interlock mechanisms and the non-planar engagement surface of the at least one of the plurality of fixed scroll support interlock mechanisms are arced about the longitudinal axis of the scroll compressor.

15. The scroll compressor of claim 8, wherein engagement of the plurality of frame interlock mechanisms with the plurality of fixed scroll support interlock mechanisms biases the frame and the fixed scroll support axially towards each other.

16. The scroll compressor of claim 8, wherein at least one of the plurality of fixed scroll support interlock mechanisms has an engagement surface having a radially varying diameter, and an engagement surface of at least one of the plurality of frame interlock mechanisms contacts the engagement surface of the at least one of the plurality of fixed scroll support interlock mechanisms upon radial rotation.

17. The scroll compressor of claim 8, wherein at least one of the plurality of frame interlock mechanisms has an engagement surface having a radially varying diameter, and the engagement surface of the at least one of the plurality of frame interlock mechanisms contacts an engagement surface of at least one of the plurality of fixed scroll support interlock mechanisms upon radial rotation.

18. The scroll compressor of claim 7, wherein the axially extending fixed scroll support interlock mechanisms are configured to engage the frame interlock mechanisms upon radial rotation.

* * * * *